US008944783B2

(12) United States Patent
Liu et al.

(10) Patent No.: US 8,944,783 B2
(45) Date of Patent: Feb. 3, 2015

(54) ELECTRIC PROGRESSIVE CAVITY PUMP

(75) Inventors: Joseph C. Liu, Ramona, OK (US); Patrick M. McCartney, Bartlesville, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1027 days.

(21) Appl. No.: 11/426,667

(22) Filed: Jun. 27, 2006

(65) Prior Publication Data

US 2007/0295510 A1 Dec. 27, 2007

(51) Int. Cl.

| | |
|---|---|
| ***F04C 13/00*** | (2006.01) |
| ***E21B 43/12*** | (2006.01) |
| ***F04C 2/107*** | (2006.01) |
| ***F04C 15/00*** | (2006.01) |

(52) U.S. Cl.

CPC ..... *E21B 43/128* (2013.01); *F04C 2/1073* (2013.01); *F04C 13/008* (2013.01); *F04C 15/008* (2013.01)

USPC ..... 417/410.3; 310/179

(58) Field of Classification Search

USPC ..... 417/410.3, 43; 310/166, 179, 180, 211, 310/212

See application file for complete search history.

(56) References Cited

U.S. PATENT DOCUMENTS

| | | | | |
|---|---|---|---|---|
| 4,463,303 | A | 7/1984 | Kirschbaum | |
| 4,473,788 | A | 9/1984 | Kirschbaum | |
| 4,476,422 | A | 10/1984 | Kirschbaum | |
| 5,825,111 | A | 10/1998 | Fei | |
| 6,078,122 | A * | 6/2000 | Tang et al. | 310/165 |
| RE37,995 | E * | 2/2003 | Barrus et al. | 417/410.3 |
| 6,581,270 | B1 * | 6/2003 | Aulanko et al. | 29/596 |
| 6,707,214 | B1 | 3/2004 | Fei | |
| 6,815,926 | B2 | 11/2004 | Fei | |
| 6,857,486 | B2 * | 2/2005 | Chitwood et al. | 175/104 |
| 6,861,780 | B2 | 3/2005 | Chang | |
| 2002/0167242 | A1 * | 11/2002 | Liu et al. | 310/184 |
| 2005/0174006 | A1 * | 8/2005 | Kolomeitsev et al. | 310/180 |
| 2005/0258701 | A1 | 11/2005 | Soitu | |
| 2006/0131987 | A1 * | 6/2006 | Uetsuji et al. | 310/270 |

FOREIGN PATENT DOCUMENTS

| | | | |
|---|---|---|---|
| EP | 0780277 | B1 | 3/2002 |

* cited by examiner

*Primary Examiner* — Charles Freay
*Assistant Examiner* — Philip Stimpert
(74) *Attorney, Agent, or Firm* — Michael Stonebrook

(57) ABSTRACT

An electric progressive cavity pump system includes a progressive cavity pump in operation connection with a six-pole, three-phase electric motor. A method of producing fluid from a wellbore includes the steps of positioning a progressive cavity pump below a fluid level in the wellbore, connecting a six-pole, three-phase electric motor that includes a stator having eighteen slots and a plurality of windings distributed among the eighteen slots, wherein the windings of different phases do not pass through the same slot and operating the progressive cavity pump via the electric motor to produce the fluid from the wellbore. The electric motor may be positioned below the fluid level in the wellbore or at the surface.

10 Claims, 4 Drawing Sheets

ELECTRIC PROGRESSIVE CAVITY PUMP

FIELD OF THE INVENTION

The present invention relates in general wellbore pumping systems and more particularly to an improved electrical progressive cavity pump and motor combination.

BACKGROUND

Conventional fluid production wells have been drilled and completed in subterranean formations often yield a desired fluid and other undesired components. For example, often in hydrocarbon wells the fluid produced will include a large percentage of undesired water production. Often included in the produced fluids is excess solids which is detrimental or incompatible with some pumping situations. For this type wells, as well as in other situations, progressive cavity pump (PCP) systems are the desired method of production.

Well economics is always driving factor in determining production systems and the viability of a particular well. The cost of operating a well is of particular concern for wells that are candidates for electrical progressive cavity pumps. A large portion of the production costs in these systems is the electrical costs and the cost of manufacturing and maintaining the PCP and electric motor. Typically electrical PCPs are driven by two-pole motors utilizing an 8:1 gearbox. Recently, four-pole motors with a 4:1 gearbox have been utilized by Schlumberger to drive PCPs providing improved system reliability relative to the two-pole motors. However, it has been realized that additional system reliability and efficiency is available. Further, the increased reliability of the four-pole motors does not utilize the ready supply of the two-pole, three-phase induction motors available.

Therefore, it is a desire to provide an electrical progressive cavity pump that addresses drawbacks of the prior art electrical progressive cavity pump systems. It is an additional desire to provide an electrical progressive cavity pump that facilitates tapping into the available supply of electrical motors. It is a still further desire to provide an electrical motor that more readily operates within its ideal frequency range to drive PCPs than the prior electrical drive motors.

SUMMARY OF THE INVENTION

Accordingly, an electric progressive cavity pump system and method of producing fluid from a wellbore is provided. An embodiment of an electric progressive cavity pump system includes a progressive cavity pump in operation connection with a six-pole, three-phase electric motor. In one embodiment the motor stator has eighteen slots and a plurality of windings distributed among the eighteen slots, wherein the windings of different phases do not pass through the same slot. Desirably the eighteen slots are formed symmetrically about the motor stator.

An embodiment of a method of producing fluid from a wellbore includes the steps of positioning a progressive cavity pump below a fluid level in the wellbore, connecting a six-pole, three-phase electric motor that includes a stator having eighteen slots and a plurality of windings distributed among the eighteen slots, wherein the windings of different phases do not pass through the same slot and operating the progressive cavity pump via the electric motor to produce the fluid from the wellbore. The electric motor may be positioned below the fluid level in the wellbore or at the surface.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
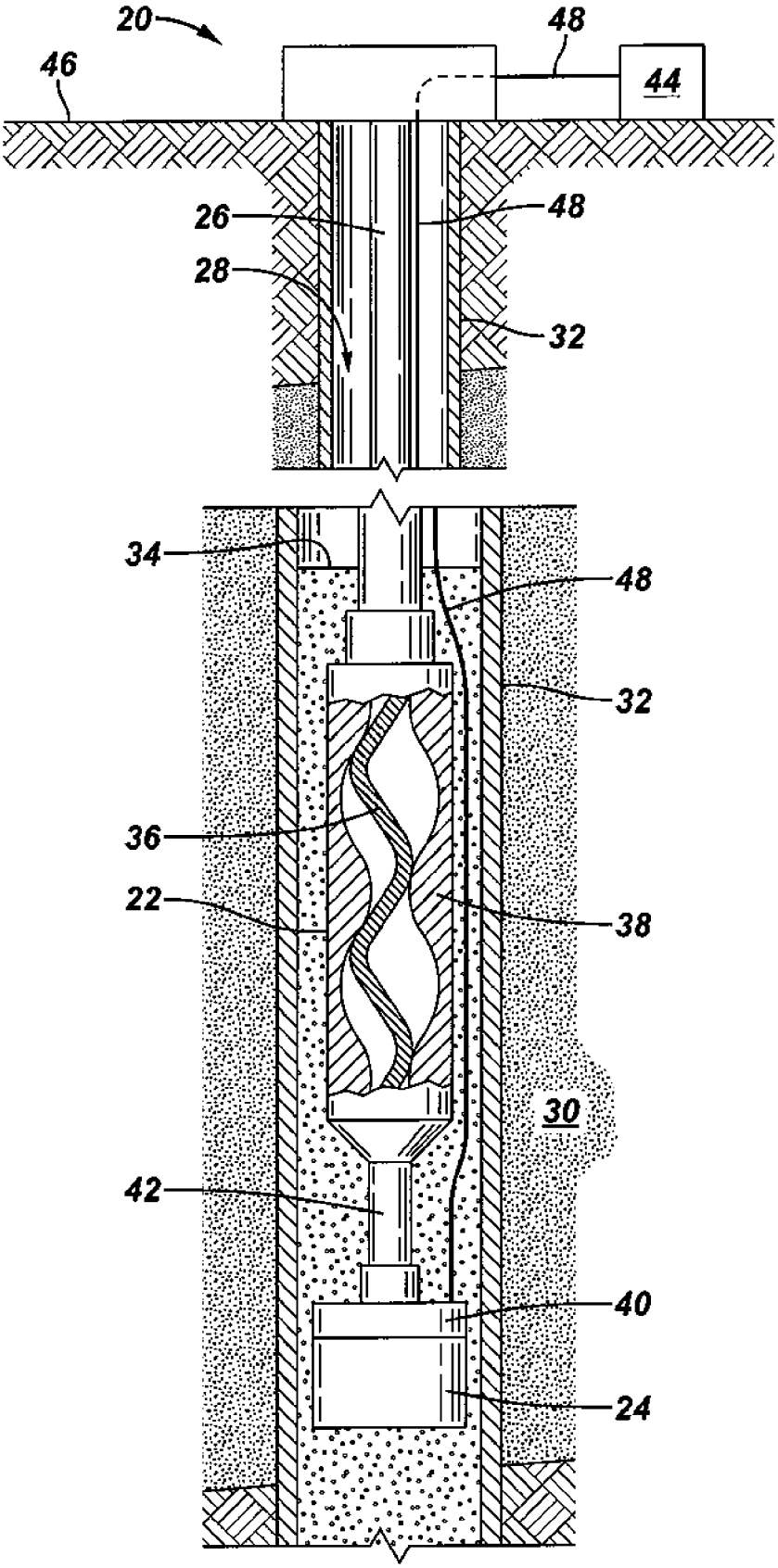
FIG. 1 is an elevation side view of an embodiment of a electrical progressive cavity pump system of the present invention.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

FIG. 1 is an elevation side view of an embodiment of an electrical progressive cavity pump (EPCP) system of the present invention, generally denoted by the numeral 20. EPCP system 20 includes an progressive cavity pump (PCP) 22 and electrical motor 24. In the illustrated embodiment, PCP 22 and motor 24 are conveyed by tubing 26 into a wellbore 28. Wellbore 28 penetrates a desired subterranean formation 30 and includes casing 32. PCP 22 and motor 24 are positioned below the fluid surface 34 in casing 32.

PCP 22, as is well known in the art, includes a rotor 36 and stator 38. PCP 22 commonly rotates between 300 to 400 revolutions per minute (RPM).

Electrical motor 24 is connected through a gear box 40 through a drive shaft 42 to PCP 22. Motor 24 is a six-pole, three-phase induction motor described in detail with reference to FIGS. 3 and 4. Motor 24 is capable of operating within its ideal frequency range to drive PCP 22 that rotates at 300 to 450 RPM with a 4:1 ratio gearbox 40.

A variable speed drive 44 positioned above ground surface 46 is connected to motor 24 via cable 48. Variable speed drive 44 provides electrical power to motor 24 and to control the output of motor 24 (e.g., speed of rotation).

Figure 2:
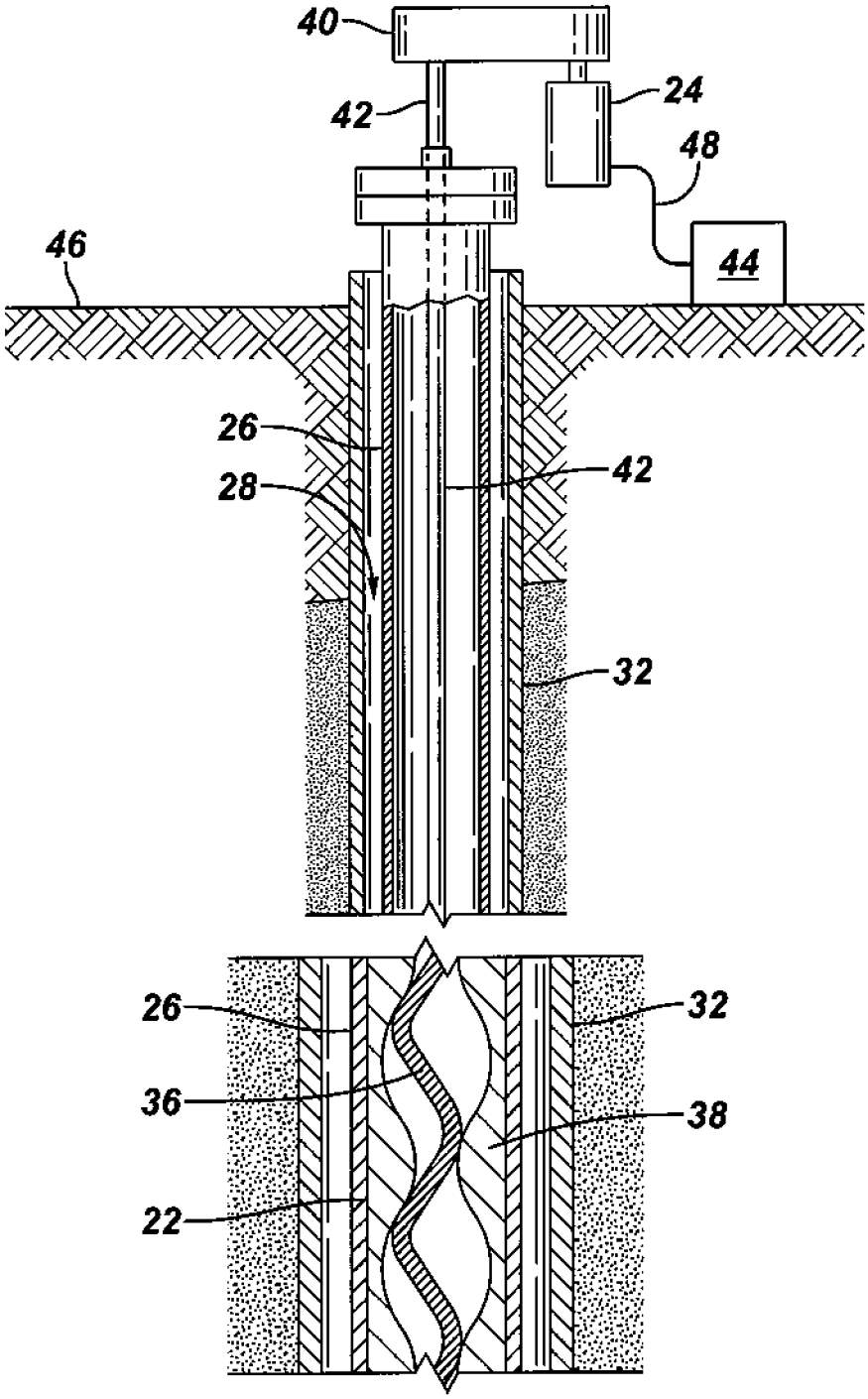
FIG. 2 is a an elevation side view of another embodiment of a progressive cavity pump system of the present invention.

FIG. 2 is an elevation side view of another embodiment of an EPCP pump system 22 of the present invention. In this embodiment, motor 24 and gearbox 40 are positioned above ground surface 46. The remaining elements of FIG. 2 have described above with reference to FIG. 1, and for the sake of brevity are herein incorporated by reference.

Figure 3:
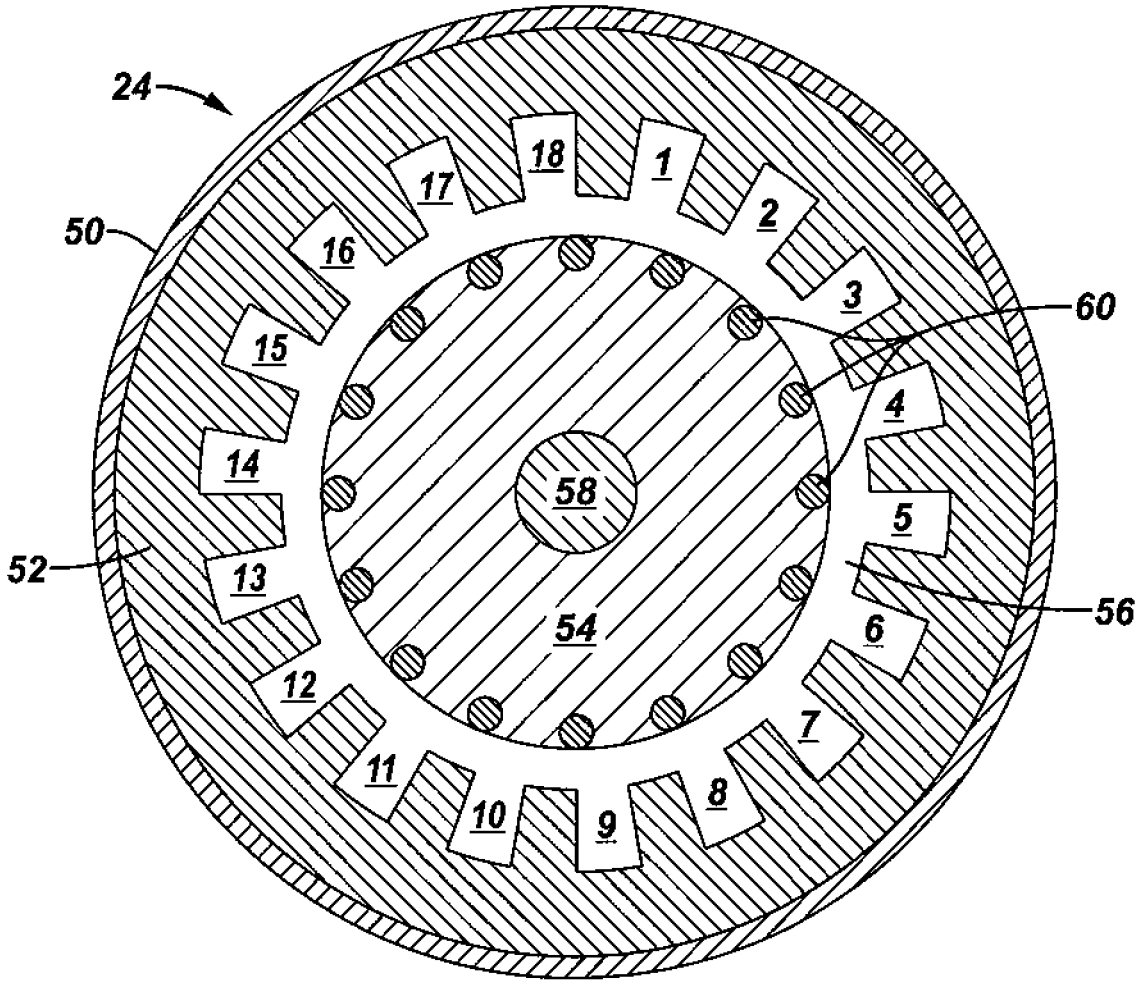
FIG. 3 is an end view of the electrical motor of FIGS. 1 and 2.

FIG. 3 is an end view of an embodiment of electrical motor 24. Motor 24 is a six-pole, three phase motor that has the benefit of a symmetrical magnetic field and non-shared slots over the prior four-pole motors. The utilization of a six-pole motor 24 of the present invention increases run life and motor efficiency over prior art EPCP systems.

Motor 24 includes housing 50, motor stator 52, eighteen slots 1-18, and motor rotor 54. Stator 52 is enclosed in housing 50 and includes eighteen slots 1-18. Coil windings (FIG. 4) are installed in slots 1-18, which when conducting alternating current, induce magnetic flux through stator 52. Rotor 54 resides within stator 52, with an air gap 56 separating motor rotor 54 from motor stator 52. Rotor 54 rotates about axis 58.

In the illustrated embodiment, motor 24 is a squirrel cage induction motor. A squirrel cage induction motor may have aluminum or copper bars 60 embedded in rotor slots and shorted at both ends by aluminum or copper end rings. Motor 24 operates by an alternating current applied to stator windings (FIG. 4), and inducing a magnetic flux (not shown) that correspondingly induces a current through conducting bars 60 in rotor 54. A corresponding force is generated to turn rotor 54 about axis 58.

Figure 4:
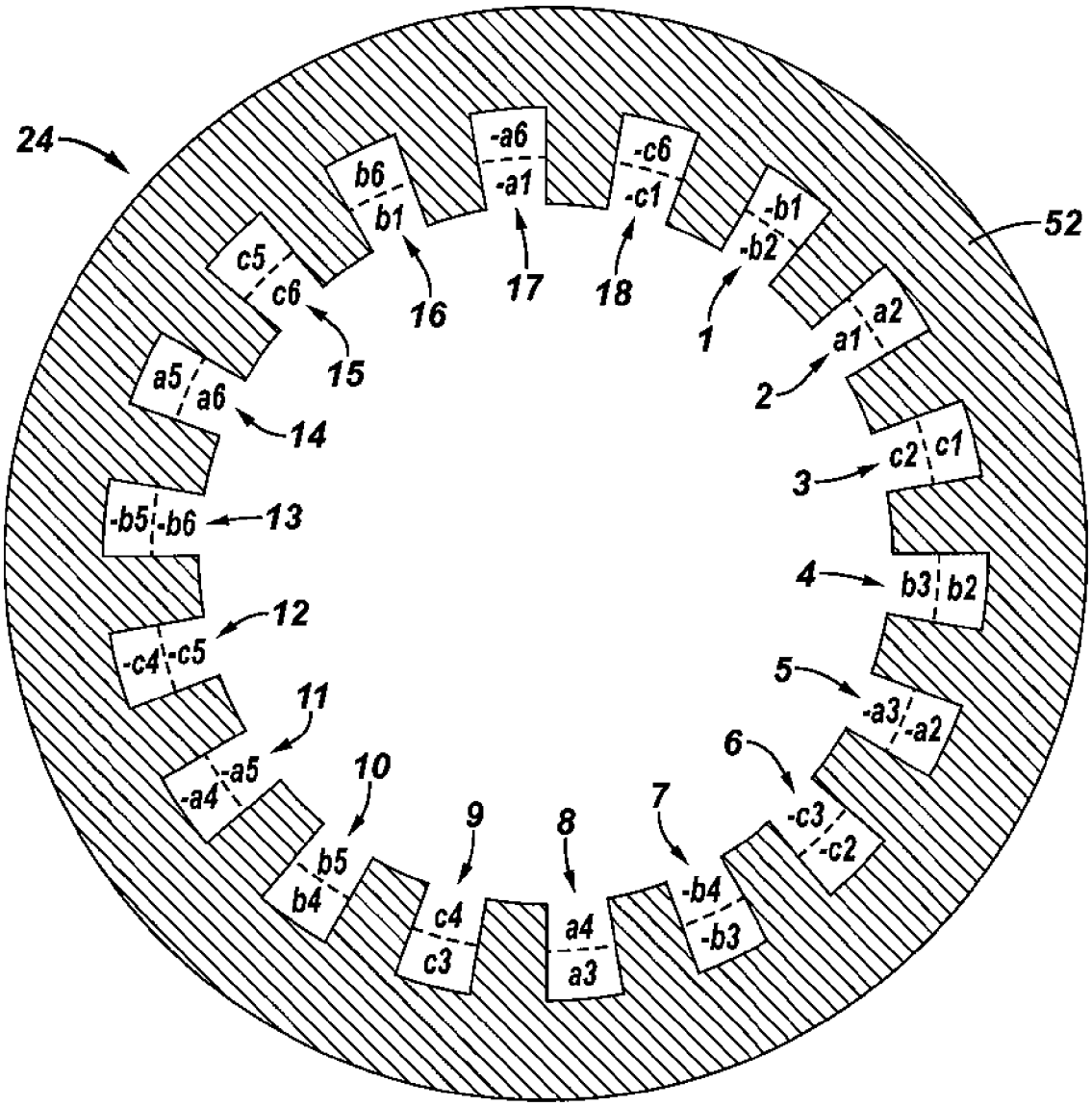
FIG. 4 is an end view of the electrical motor of FIGS. 1 to 3 illustrating the coil winding.

FIG. 4 is another end view of motor 24 illustrating the coil windings for motor 24 to operate as a six-pole, three-phase induction motor. There are numerous ways to wind an induction motor, and providing such an example is not meant to limit the claim scope of the present invention. The layout of windings in electric machines such as motor 24 affects the magnemotive force (MMF) distribution and corresponding performance of the machine. Coils of a winding can be placed in two slots to form a winding known as a concentrated winding. Coils can also be distributed over more than one slot to form a winding known as a distributed winding. Machine reliability is adversely affected by placing windings having different electrical potentials in the same slot. Further, it may be advantageous to configure windings such that electrical poles formed by the windings are symmetrically positioned.

There are eighteen slots in stator 52 labeled 1-18. Stator 52 is wound to form a six-pole, three-phase, distributed winding. In each of the eighteen slots 1-18, two coil sides are placed in a double layer arrangement, one side of a coil placed at the top of one slot while the other side of the coil is placed at the bottom of another slot. For example, for coil a1, −a1, one side of the coil (a1) is placed at the top of slot 2 and the other side of the coil (−a1) is placed at the bottom of slot 17. Coil sides that belong to the same phase, such as a1, a2, a3, a4, a5, a6 constitute a phase belt. Because the coils in FIG. 4 span less than a full pole pitch, such a winding is commonly referred to as short pitch, fractional pitch, or chorded winding. In FIG. 4, a coil such as a1, −a1 spans 20 electrical degrees. Slots are arranged symmetrically about stator 52. This results in electrical symmetry.

From the foregoing detailed description of specific embodiments of the invention, it should be apparent that an electric progressive cavity pump system that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. An electric progressive cavity pump system, the system comprising:

a progressive cavity pump positioned in a wellbore;

a six-pole, three-phase integer slots-per-pole ratio electric motor positioned in the wellbore and operatively connected to the progressive cavity pump, wherein the electric motor comprises:

a rotor;

a stator comprising eighteen slots; and a plurality of windings, the plurality of windings being distributed among the eighteen slots, each of the plurality of windings comprising two coil sides, one of the two coil sides positioned in a top of one of the eighteen slots and the other of the two coil sides positioned in a bottom of one of the other of the eighteen slots, the plurality of windings are arranged in the plurality of slots such that electrical poles formed by the windings are symmetrically positioned, and wherein the windings of different phases do not pass through the same slot in each of the eighteen slots; and a variable speed drive positioned above a ground surface and connected to the six-pole, three-phase integer slots-per-pole ratio electric motor to provide electrical power and to control a motor output.

2. The system of claim 1, wherein the eighteen slots are formed symmetrically about the stator.

3. The system of claim 1, wherein the progressive cavity pump operates in the range of 300 to 450 revolutions per minute.

4. The system of claim 1, further including a gearbox connected between the motor and the progressive cavity pump.

5. The system of claim 4, wherein the gearbox is geared to a 4:1 ratio.

6. A submersible electric progressive cavity pump system, the system comprising:

a wellbore drilled from the ground surface to a subterranean formation, the wellbore containing a fluid;

a progressive cavity pump positioned in the wellbore below the fluid level;

a six-pole, three-phase integer slots-per-pole ratio electric motor operatively connected to the progressive cavity pump and positioned in the wellbore, the electric motor comprising:

a plurality of windings arranged in coils which span less than a full pole pitch, the plurality of windings being distributed among the slots, each of the plurality of windings comprising two coil sides, one of the two coil sides positioned in a top of one of the plurality of slots and the other of the two coil sides positioned in a bottom of one of the other of the plurality of slots, the plurality of windings are arranged in the plurality of slots such that electrical poles formed by the windings are symmetrically positioned; and a variable speed drive positioned above the ground surface and connected to the six-pole, three-phase integer slots-per-pole ratio electric motor to provide electrical power and to control a motor output.

7. The system of claim 6, wherein the electric motor is positioned in the wellbore below the fluid level.

8. The system of claim 6, wherein the electric motor comprises eighteen slots formed symmetrically about a motor stator.

9. The system of claim 6, further including a 4:1 ratio gearbox adapted to operate the progressive cavity pump at 300 to 450 revolutions per minute.

10. The system of claim 8, further including a 4:1 ratio gearbox adapted to operate the progressive cavity pump at 300 to 400 revolutions per minute.

* * * * *